United States Patent [19]

Saunders

[11] Patent Number: 4,726,208

[45] Date of Patent: Feb. 23, 1988

[54] FLAT-ROLLED STEEL CAN STOCK MANUFACTURE

[75] Inventor: William T. Saunders, Weirton, W. Va.

[73] Assignee: Weirton Steel Corporation, Weirton, W. Va.

[21] Appl. No.: 857,108

[22] Filed: Apr. 29, 1986

[51] Int. Cl.[4] ..... B21D 22/20; C25D 5/10; C25D 5/50; C25D 7/06

[52] U.S. Cl. ..... 72/47; 204/28; 204/35.1; 204/37.3; 204/38.7; 204/40

[58] Field of Search ..... 204/27, 28, 35.1, 38.7, 204/37.3, 40; 72/47

[56] References Cited

U.S. PATENT DOCUMENTS

| | | | |
|---|---|---|---|
| 3,062,726 | 11/1962 | Hill | 204/40 |
| 3,174,917 | 3/1965 | Lesney et al. | 204/37 |
| 3,285,838 | 11/1966 | Morgan et al. | 204/37 |
| 3,652,234 | 3/1972 | Lamantia | 29/183.5 |
| 3,934,527 | 1/1976 | Saunders | 113/120 A |
| 4,113,580 | 9/1978 | Tsutsui et al. | 204/37.3 |
| 4,483,907 | 11/1984 | Salm | 428/629 |
| 4,501,802 | 2/1985 | Higuchi et al. | 428/629 |
| 4,579,786 | 4/1986 | Nakakouji et al. | 428/648 |

*Primary Examiner*—John F. Niebling
*Assistant Examiner*—William T. Leader
*Attorney, Agent, or Firm*—Raymond N. Baker

[57] ABSTRACT

Composite-coated flat-rolled steel can stock processing and product for fabrication of sheet metal cans, in particular for three-piece, welded or cemented side seam cans. Single or double-reduced, low carbon, flat-rolled steel of a gage in the range of about 55 to 110 pounds per base box is flash coated with tin (0.05 #/bb), which is alloyed with the steel base metal; at least 0.20 #/bb of tin is added to one surface only, flow brightened and water quenched; chemical treatment chrome oxide coating of about 100 to 750 milligrams per square foot is added to both surfaces and an organic coating of 2.5 to 15 milligrams per square inch is added to the surface which is free of flow-brightened tin for disposition internally of a can fabricated from such coated can stock. The equivalent of quarter-pound and higher coating weight tinplate protection is provided while decreasing tin requirements and maintaining three-piece can fabrication properties not available with coating metal substitutes for tin.

8 Claims, 4 Drawing Figures

FIG. 2
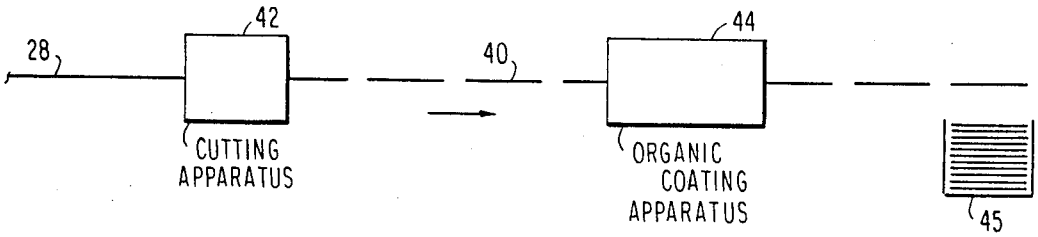
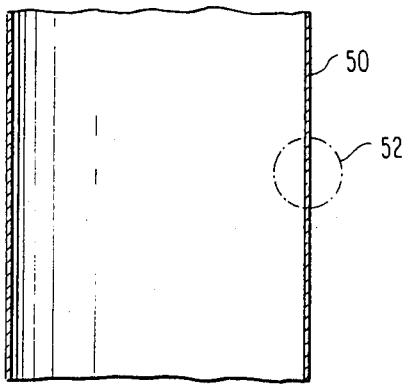
FIG. 3
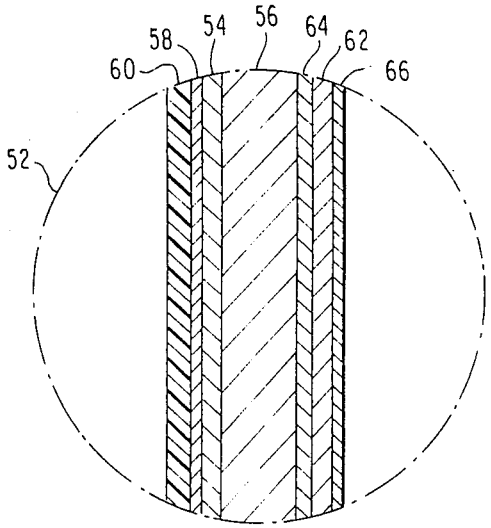
FIG. 4

FLAT-ROLLED STEEL CAN STOCK MANUFACTURE

This invention relates to flat-rolled steel can stock coating methods and products; and, in one of its more specific aspects, is concerned with flat-rolled steel can stock for manufacture of three-piece steel cans.

For many years, flow-brightened electrolytic tinplate established the protection and appearance standards, and also side-seam fabrication practices, in the manufacture of three-piece sanitary cans. Tin coating weights in excess of a pound per base box were often required on interior surfaces of a can dependent on the product being canned and its processing.

Increased tin costs fostered increased investigation by the flat-rolled steel industry into electroplating metal substitutes such as chromium (used in producing so-called tin free steel (TFS)), nickel, nickel-zinc, etc. Of these, only TFS has found continuing commercial use and replaced significant amounts of tinplate. But, commercial application of TFS also has its limitations, e.g. in the special measures required for fabrication of seamed side walls for three-piece cans. Further, possibly because of plating inefficiencies, steel mills which have tinplating facilities may not have, or may have chosen not to add, the electroplating capacity to produce TFS.

Important contributions of the present invention include a flat-rolled steel can stock which can be produced at readily available steel mill facilities worldwide and which decreases tin requirements while providing desired protection, appearance and side wall fabrication characteristics for three-piece cans and avoiding limitations of tin substitutes. Separately applied and separately treated coatings are utilized to provide an economic flat-rolled steel composite-coated can stock for use throughout three-piece can manufacture.

Other advantages and contributions of the invention are considered in more detail in relation to the accompanying drawings, in which:

FIG. 2 shows partial processing of flat-rolled steel in cut sheet form for selected can stock in accordance with the invention, which processing is adapted to be substituted for a portion of the continuous strip processing of FIG. 1;

FIG. 3 is a cross-sectional schematic of a portion of a can made from flat-rolled steel processed in accordance with the invention; and FIG. 4 is an enlarged view of a portion of such can of FIG. 3.

Figure 1:
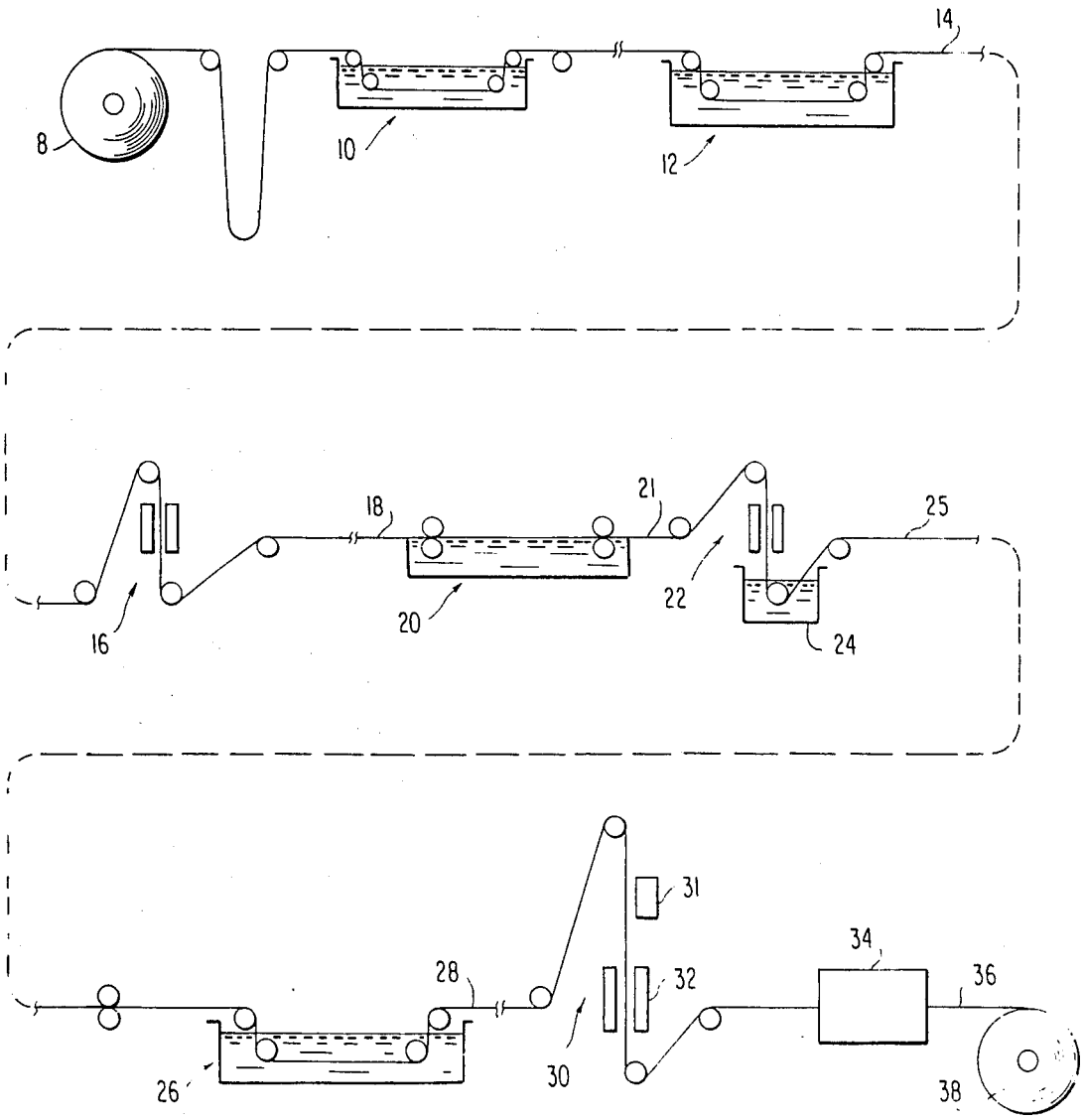
FIG. 1 is a schematic presentation of continuous-strip flat-rolled steel processing in accordance with the present invention.

Cold-rolled, single-reduced or double-reduced, low-carbon flat-rolled steel of about fifty-five (55) to about one hundred ten (110) pounds per base box is utilized in practice of the invention.

A new tinplated, composite-coated flat-rolled steel can stock is provided which contributes various can manufacturing advantages, e.g. side wall seaming obstacles of tin substitutes are surmounted and internal can surface protection properties equivalent to conventional quarter-pound and higher coating weight tinplate are achieved using less tin.

Also, the invention enables continuous-strip processing throughout can stock manufacture for such final products as can ends. Continuous-strip processing is interrupted in producing can stock for seamed side walls with final stages of the processing adapted to selective application of an organic coating to enable side wall seaming, by welding or cementing, without requirement for scarfing or other modification of the coating(s) on edge portions of the can stock before seaming.

Referring to FIG. 1, both planar surfaces of the flat-rolled steel substrate from coil 8 are prepared for plating in steel substrate cleansing means 10; known surface cleaning techniques can include a pickling bath treatment. Then both surfaces are electrolytically tinplated using, for example, a Halogen-type process (U.S. Pat. No. #3,264,198) as represented by plating cell means 12. A flash coating of tin of about 0.05 #/bb (total weight—both sides) is applied to the planar surfaces of the strip initially.

Tin coating weights are expressed herein in accordance with tinplated steel practice (see MS&T of Steel, 6th Ed. 1951, published by U.S. Steel Company, Pittsburgh, Pa., pages 975 and 1433) as the total coating weight of tin on both surfaces of the steel substrate; the actual tin coating weight on one surface, unless otherwise specified, is one-half such total coating weight.

The flash-coated tinplated strip 14 is directed to heating apparatus 16, such as a known type of induction heater with controls, where at least a portion of the flash-coated tin is alloyed with the base metal. A major portion, e.g. about 75% to about 90% of such flash-coated tin is preferably alloyed at this stage in heating apparatus 16. Full alloying of the flash-coated tin can be carried out in heating apparatus 16 but is not required at this stage in the manufacturing process of the present invention because of a subsequent heat treatment step. This coaction between separate coating steps and separate heat treatments of the invention contributes to manufacturing economies.

The flash-coated steel substrate 18, with the tin at least partially alloyed, is directed to a second electrolytic tinplating apparatus represented by plating cell means 20 in which tin is applied solely to one surface; the tin is added to such surface and can extend to about one and a half pounds per base box. Preferably, the flash coating of tin and tin added to such one surface comprises a nominal tin coating weight of at least about 0.25 #/bb on such surface. The remaining surface has a nominal tin coating weight of about 0.05 #/bb as originally applied by flash coating. These nominal tin coating weights do not include any increase in coating weight due to the alloying of the tin with the steel base metal.

Coated substrate 21 is directed to heating apparatus 22 in which the added tin is flow brightened, using a known type of induction heating means with controls, followed by water quenching in bath 24. Further alloying of any non-alloyed portions of the flash coating of tin with the base metal is accomplished as part of this flow-brightening step.

Such dual electroplating—dual induction heating steps produce tinplated strip 25 with alloyed tin-iron on both surfaces of the steel substrate; such alloyed tin-iron surface is exposed on one side of the substrate and a flow-brightened tin surface is exposed on the other side.

Tinplated strip 25 is then directed to dichromate chemical treatment means 26 for chemical treatment application of a chrome oxide layer to both surfaces of the tinplated substrate. Such chemical treatment enhances both surfaces, for differing purposes, as disclosed later herein.

Sodium dichromate is a satisfactory solution for such chemical treatment. A dichromate treatment can be carried out by immersion, with no electric current applied, to deposit about one hundred fifty (150) micrograms of chrome oxide per square foot plus or minus one hundred (100) $\mu g/ft^2$.

This chemical treatment application of chrome oxide is carried out immediately after tin reflow and quench. Such application of chrome oxide inhibits growth of tin oxide on the flow brightened tin surface but also influences organic coating adhesion and wettability of such surface; such treatment is not detrimental to side seam welding or cementing.

Dichromate treatments, per se, are known in the art as are classifications thereof; Class 1 comprises the above immersion treatment only; cathodic dichromate (CDC) treatment uses electric current. Typical classifications and coating weights are:

CDC-3 $350 \pm 100$ $\mu g/ft^2$
CDC-5 $550 \pm 100$ $\mu g/ft^2$
CDC-7 $650 \pm 100$ $\mu g/ft^2$

Class 5 CDC treatment is utilized, for can interior protection purposes, in a preferred embodiment of the invention.

Chemical treatment means 26 are used to apply a chrome oxide coating to both surfaces of the strip. One of the advantages of the invention is that such chemical treatment chrome oxide layer can be applied in any type of continuous-strip bath treatment line such as a conventional line used for electrotinplating since CDC electrolytic action does not require the electroplating capacities of TFS.

Such chemical treatment chrome oxide coating serves dual purposes on the tin-iron alloy surface; it provides added protection on the interior of a can manufactured from such can stock and, also, enhances application and adhesion of an organic coating on that surface, as subsequently added as part of the invention.

The chrome oxide coating passivates the tinned surface, especially the can-exterior flow-brightened surface, providing for long storage without discoloration.

When the flat-rolled steel can stock of the invention is being produced for products which do not require a side wall seam, such as end walls for cans, continuous-strip processing of chemically treated strip 28, as shown in FIG. 1, is continued. Chemically treated strip 28 is directed to organic coating means 30 where an organic coating is applied to the chemically treated side of the strip which is free of flow-brightened tin, i.e. the surface which is to be used internally of the can manufactured from the can stock being produced.

As taught herein, epoxies, polyesters, vinyls, acrylics and like types of organic polymeric coatings, known in the can industry as "organic coatings", which are commercially available and generally used with TFS surfaces will adhere to a CDC treated tin-iron alloy surface, application and curing conditions for such organic coatings are known in the art.

Coating apparatus 30 can be used for applying a liquid based or solid laminate coating. applicator means 31 applies the organic coating solely to the surface of strip to be disposed on the interior of the can. The organic coating is then cured in heating apparatus 32 by induction heating which can be supplemented with infrared heating means known in the art. Non-alloyed portions, if any, of the flash coating of tin would be alloyed by such induction heating before applying the organic coating.

With the present invention, no organic coating is applied or required on the flow-brightened tin surface which has been passivated by chemical treatment for manufacture of sanitary cans; this contrasts with tin substitute metal platings which can require an organic coating for handling or can fabricating purposes. A suitable lubricant, to prevent surface abrasion of the organic coating during coiling, can be applied at lube means 34 to strip 36 prior to forming coil 38; such lubricants are known in the art.

In producing flat-rolled steel can stock for manufacture of three-piece can side walls, provisions are made for leaving edge margins of sheet portions free of organic coating in order to avoid interference with side wall seaming operations.

For this purpose, chemically treated continuous strip 28 is cut transversely of its rolling direction into individual sheets 40 at cutting apparatus 42 (FIG. 2) prior to applying organic coating in apparatus 44. The chrome oxide coated tin-iron alloy surface of an individual sheet is then organically coated across its width in selected areas. Bands of predetermined length in the rolling direction are coated so as to provide edge margins, for can side wall portions cut from such sheets, which are free of organic coating to facilitate side wall seaming. Roller coating, in a manner known in the art, can be used for selectively applying organic coating to provide such edge margins. Such individual sheets with selected areas free of organic coating are accumulated at stack 45.

The side wall of a three-piece can is fabricated by forming a tubular configuration from such organically coated sheet portions by winding with the rolling direction extending around the circumference of the tubular configuration side wall; such "C" grain winding is known in the art. The edge margins extend longitudinally parallel to the central axis of the tubular configuration. Side wall seaming is carried out by welding or cementing; none of the other coatings at the edge margins, neither the tin-iron alloy, flow-brightened tin, or chemical treatment coating of the present invention, prevent commercially satisfactory welding or cementing of side wall seams. Side seam welding or cementing methods and apparatus, per se, are known in the art and are commercially available.

The coating layers are shown in the enlarged cross-sectional view of segment 52 in FIG. 4. A fully alloyed flash coating (0.05 #/bb) of tin 54 on substrate 56 is on the interior side of the can; overlaying such alloyed flash coating of tin is a chemical treatment chrome oxide coating 58 preferably of about five hundred (500) micrograms per square foot, and overlaying that chemical treatment layer is organic coating 60 of about 2.5 to 15 milligrams per square inch. Protection equivalent to at least quarter-pound (0.25 #/bb) tinplate is provided on the interior of a can with such composite coating of the invention.

On the surface for the can exterior, a flow-brightened tin coating 62 of at least about 0.20 #/bb overlays the alloyed flash coating (0.05 #/bb) of tin 64; a chemical treatment chrome oxide layer 66, typically about the same as that applied to the can interior surface, overlays such flow-brightened tin surface for passivation purposes.

Both can end walls and side walls for sanitary cans would include the composite coatings as shown in detail in FIG. 4.

Representative data for carrying out the invention are as follows:

| | |
|---|---|
| Flat-rolled steel base metal | about 55 to 90 #/bb for side walls<br>about 75 to 112 #/bb for end walls |
| Flash coating of tin (alloyed with iron of the flat-rolled steel substrate) | about .05 #/bb |
| Additional plated tin (solely on one surface which is flow brightened) | above about .20 #/bb |
| Chrome oxide coating | Class 1 to CDC Class 7, each surface |
| Organic coating | about 2.5 to 15 mg/in, interior surface only |

A typical single reduced flat-rolled steel for welded seam side walls would be about 75 #/bb having a nominal thickness of 0.0083" (0.211 mm); a typical double-reduced flat-rolled steel for welded seam side walls would be about 60 #/bb having a nominal thickness of 0.0066" (0.168 mm).

While specific steps and data have been set forth, it is understood that, in the light of the above disclosure, other values could be selected by those skilled in the art; therefore, for purposes of defining the scope of the invention, reference shall be had to the appended claims.

I claim:

1. Process for manufacturing coated flat-rolled steel can stock, comprising
   - providing a low-carbon flat-rolled steel continuous-strip substrate,
   - preparing both surfaces of such substrate for plating,
   - electrolytically tinplating both such surfaces with a flash coating of tin of about 0.05 #/bb,
   - induction heating such substrate to convert at least a portion of such flash coating of tin to tin-iron alloy,
   - electrolytically tinplating one surface only of such at least partially alloyed tin coated substrate, such one surface being additionally plated with tin above about 0.20 #/bb,
   - flow brightening such added tin by induction heating of such substrate followed by cooling thereof,
   - such flow-brightening step being carried out to enable further alloying of non-alloyed portions, if any, of such flash coating of tin while avoiding full alloying of such added tin with the iron of such steel substrate, then
   - chemically treating such strip to apply a chrome oxide coating to both surfaces thereof, then
   - applying an organic coating solely to such chemically treated surface of the substrate which is free of added flow-brightened tin, and
   - heating curing such organic coating.

2. The process of claim 1 in which
   - such chemical treatment step consists of a cathodic dichromate treatment carried out to provide a chrome oxide coating weight in the range of about 250 to about 750 micrograms per square foot of each surface.

3. The process of claim 1 in which
   - such organic coating step is carried out to provide a coating weight of about 2.5 to about 15 milligrams per square inch of such surface.

4. The process of claim 3 for use in sheet metal can manufacture further including
   - fabricating a portion of a sheet metal can from such coated can stock in which such surface which includes such organic coating is disposed to present an internal surface of such can.

5. The process of claim 3 for use in the manufacture of can stock for sheet metal can end walls in which
   - such flat-rolled steel is selected in the range of about 75 to about 110 #/bb, and
   - such organic coating step is carried out on such substrate while in continuous strip form.

6. The process of claim 3 for use in the manufacture of can stock for seamed side walls of three-piece sheet metal cans in which
   - such flat-rolled steel is selected in the range of about 55 to about 90 #/bb, further including
   - prior to such organic coating step
   - cutting such continuous strip substrate transversely of its rolling direction into individual sheets of predetermined length, and
   - such organic coating step is carried out to apply organic coating to selected areas of such individual sheets to provide edge margins on side wall portions to be cut from such sheets,
   - such edge margins being free of organic coating to facilitate formation of a side wall seam.

7. The process of claim 3 in which such organic coating is selected from the group consisting of epoxies, vinyls, polyesters, acrylics, and combinations thereof.

8. The process of claim 1 in which about 75% of such flash coating of tin is converted to tin-iron alloy by such induction heating step carried out prior to applying such additional plating of tin to such one surface.

* * * * *